US009411300B2

(12) United States Patent
Ai

(10) Patent No.: US 9,411,300 B2
(45) Date of Patent: Aug. 9, 2016

(54) IMAGE FORMING APPARATUS AND CLEANING BLADE

(71) Applicant: CANON KABUSHIKI KAISHA, Tokyo (JP)

(72) Inventor: Ryuta Ai, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/708,521

(22) Filed: May 11, 2015

(65) Prior Publication Data

US 2015/0338819 A1 Nov. 26, 2015

(30) Foreign Application Priority Data

May 22, 2014 (JP) ..... 2014-106045

(51) Int. Cl.
*G03G 21/00* (2006.01)

(52) U.S. Cl.
CPC ..... *G03G 21/0011* (2013.01); *G03G 21/0017* (2013.01)

(58) Field of Classification Search
CPC ..... G03G 21/0011; G03G 21/0017; B29C 41/003; B29C 41/22
USPC ..... 399/350
See application file for complete search history.

(56) References Cited

U.S. PATENT DOCUMENTS

| | | | | |
|---|---|---|---|---|
| 8,204,424 | B2 | 6/2012 | Miki et al. | |
| 8,913,944 | B2 | 12/2014 | Sakon et al. | |
| 2003/0081971 | A1* | 5/2003 | Nakayama | G03G 21/0011 399/350 |
| 2005/0141923 | A1* | 6/2005 | Ota | G03G 21/0017 399/350 X |
| 2006/0285898 | A1 | 12/2006 | Watanabe et al. | |
| 2009/0041518 | A1* | 2/2009 | Kishi | G03G 21/0017 399/350 |
| 2010/0008707 | A1* | 1/2010 | Sako | G03G 21/0017 399/350 |
| 2012/0163890 | A1 | 6/2012 | Uematsu et al. | |
| 2013/0189012 | A1* | 7/2013 | Sakon | G03G 21/0017 399/350 |
| 2013/0236208 | A1* | 9/2013 | Komatsu | G03G 21/0017 399/350 X |
| 2013/0243506 | A1 | 9/2013 | Ikuno et al. | |
| 2014/0086624 | A1* | 3/2014 | Kojima | G03G 21/0017 399/350 X |

FOREIGN PATENT DOCUMENTS

| | | | |
|---|---|---|---|
| JP | 9-127846 | A | 5/1997 |
| JP | 11-73075 | A | 3/1999 |
| JP | 2007-30385 | A | 2/2007 |
| JP | 2007-052062 | A | 3/2007 |
| JP | 2008-268494 | A | 11/2008 |
| JP | 2010-170157 | A | 8/2010 |
| JP | 2013-109369 | A | 6/2013 |
| JP | 2013-174858 | A | 9/2013 |

OTHER PUBLICATIONS

Extended European Search Report in European Application No. 15166701.1 (dated Oct. 19, 2015).

* cited by examiner

*Primary Examiner* — Sophia S Chen
(74) *Attorney, Agent, or Firm* — Fitzpatrick, Cella, Harper & Scinto

(57) ABSTRACT

An image forming apparatus includes: a rotatable image bearing member; an image forming portion; and a cleaning blade. The cleaning blade has an edge layer which includes an edge portion contacting the image bearing member and which is formed of a first resin material, and has a base layer which is provided superposedly on the edge layer so as to support the edge layer with respect to a thickness direction of the cleaning blade and which is formed of a second resin material different from the first resin material. The cleaning blade includes a hardened portion, at a part of the edge layer including the edge portion, subjected to hardening so as to be harder than another portion of the edge layer. The hardened portion has a length shorter than a length of the edge layer with respect to the thickness direction.

24 Claims, 7 Drawing Sheets

IMAGE FORMING APPARATUS AND CLEANING BLADE

FIELD OF THE INVENTION AND RELATED ART

The present invention relates to an image forming apparatus of an electrophotographic type, an electrostatic recording type or the like and a cleaning blade for removing residual toner from an image bearing member such as a photosensitive drum in such an image forming apparatus.

An image forming apparatus of the electrophotographic type is widely used as a copying machine, a printer, a plotter, a facsimile machine, a multifunction machine having functions of them, or the like. In the image forming apparatus of this type, a toner image is formed on a photosensitive drum as an example of the image bearing member and is transferred onto an intermediary transfer member or a recording material in the form of a sheet.

In the image forming apparatus, toner remaining on the photosensitive drum after image transfer onto the recording material is removed by a cleaning blade. The cleaning blade is normally provided and press-contacted to the photosensitive drum counterdirectionally with respect to a rotational direction of the photosensitive drum. For this reason, a frictional force between the photosensitive drum and the cleaning blade is large, and therefore an edge portion of the cleaning blade is everted with respect to the rotational direction of the photosensitive drum, so that everting of the cleaning blade can generate. Particularly in an outside of an image forming region, an amount of the toner or an external additive which reaches the cleaning blade is small, as compared with the image forming region. The toner and the external additive are effective to maintain a sliding property between the cleaning blade and the photosensitive drum, and therefore, in the outside of the image forming region short of the toner and the external additive, the everting of the cleaning blade tends to occur.

In order to suppress the everting of the cleaning blade in the outside of the image forming region, Japanese Laid-open Patent Application 2010-170157 discloses that a treated portion is provided at each of the opposite end portions of a longitudinal direction of the cleaning blade (widthwise direction of the apparatus). This cleaning blade is impregnated with an isocyanate compound from an edge side end surface of the cleaning blade so that opposite widthwise end portions of the end surface is hardened. With this cleaning blade, a portion contacting the outside of the image forming region which carries less toner or external additive has been hardened, and therefore, the everting of the cleaning blade can be suppressed.

On the other hand, Japanese Laid-open Patent Application 2013-109369 discloses that in order to accomplish both of the anti-wearing property and the cleaning property, a two-layer-structure is used in which the cleaning blade comprises a base layer and an edge layer which are formed of different materials. More specifically, the edge layer and the base layer of the cleaning blade are formed of rubber materials having different properties, so that rubber hardnesses and impact resiliences of the edge layer and the base layer are made different.

With such a cleaning blade, the function of the edge layer having the property suitable to the contact to the photosensitive drum and the function of the base layer having the property suitable to support the edge layer can be separated.

Therefore, the functions can be performed without mutual influence, and therefore, the anti-wearing property and the cleaning property can be both accomplished.

However, the cleaning blade having a two-layer-structure of the elastic rubber member disclosed in Japanese Laid-open Patent Application 2013-109369 encountered the following problem when the hardening (treatment) is made at the opposite end portions (with respect to the widthwise direction) of the edge portion side end surface of the cleaning blade as in the case of Japanese Laid-open Patent Application 2010-170157. Since the cleaning blade of Japanese Laid-open Patent Application 2013-109369 having the two-layer-structure including the edge layer and the base layer, both of the edge layer and the base layer are hardened by the hardening at the opposite end portions with respect to the widthwise direction. Since physical properties of the rubber materials for the edge layer and the base layer are different from each other, hardening conditions are also different, and therefore, the base layer may be over-hardened when the hardening is made under the hardening condition suitable for the edge layer. In such a case, the portion of the base layer that is subjected to the hardening is swelled excessively with the result of a larger stepped portion between the hardened portion and the unhardened portion, with the possible result of defective cleaning at a boundary area between them. More particularly, when the cleaning blade contacted to the image bearing member removes the residual toner, the toner may slip through at the stepped portion.

SUMMARY OF THE INVENTION

Accordingly, it is an object of the present invention to provide an image forming apparatus employing a cleaning blade including an edge layer and a base layer of different materials, wherein generation of the above-described stepped portion by the hardening (treatment) is suppressed.

According to an aspect of the present invention, there is provided an image forming apparatus comprising: a rotatable image bearing member; an image forming portion for forming a toner image on the image bearing member; and a cleaning blade for removing a toner on the image bearing member in contact with the image bearing member, wherein the cleaning blade has an edge layer which includes an edge portion contacting the image bearing member and which is formed of a first resin material, and has a base layer which is provided superposedly on the edge layer so as to support the edge layer with respect to a thickness direction of the cleaning blade and which is formed of a second resin material different from the first resin material, wherein the cleaning blade includes a hardened portion, at a part of the edge layer including the edge portion, subjected to hardening so as to be harder than another portion of the edge layer, and wherein the hardened portion has a length shorter than a length of the edge layer with respect to the thickness direction.

According to another aspect of the present invention, there is provided a cleaning blade comprising: an edge layer which includes an edge portion and which is formed of a first resin material; a base layer which is provided superposedly on the edge layer so as to support the edge layer with respect to a thickness direction of the cleaning blade and which is formed of a second resin material different from the first resin material; and a hardened portion, provided at a part of the edge layer including the edge portion, subjected to hardening so as to be harder than another portion of the edge layer, wherein the hardened portion has a length shorter than a length of the edge layer with respect to the thickness direction.

According to another aspect of the present invention, there is provided an image forming apparatus comprising: a rotatable image bearing member; and a cleaning blade for removing a toner on the image bearing member in contact with the image bearing member, wherein the cleaning blade has an edge layer which includes an edge portion contacting the image bearing member and which is formed of a first resin material, and has a base layer which supports the edge layer and which is formed of a second resin material different from the first resin material, wherein the cleaning blade includes a hardened portion, at a part of the edge layer including the edge portion, subjected to hardening so as to be harder than another portion of the edge layer, and wherein in the edge layer including the edge portion, between the hardened portion and a region other than the hardened portion, a difference in thickness of the cleaning blade is 25 μm or less and a difference in dynamic hardness is 0.07 mN/(μm×μm) or more and 0.27 mN (μm×μm) or less.

According to another aspect of the present invention, there is provided a cleaning blade comprising: an edge layer which includes an edge portion and which is formed of a first resin material; a base layer which supports the edge layer and which is formed of a second resin material different from the first resin material; and a hardened portion, provided at a part of the edge layer including the edge portion, subjected to hardening so as to be harder than another portion of the edge layer, wherein in the edge layer including the edge portion, between the hardened portion and a region other than the hardened portion, a difference in thickness of the cleaning blade is 25 μm or less and a difference in dynamic hardness is 0.07 mN/(μm×μm) or more and 0.27 mN (μm×μm) or less.

According to another aspect of the present invention, there is provided an image forming apparatus comprising: a rotatable image bearing member; and a cleaning blade for removing a toner in contact with the image bearing member, wherein the cleaning blade has an edge layer which includes an edge portion contacting the image bearing member and which is formed of a first resin material, and has a base layer which supports the edge layer and which is formed of a second resin material different from the first resin material, wherein a portion which is a part of the edge layer including the edge portion and which extends from a surface of the edge layer and does not reach the base layer is subjected to hardening so as to be harder than another portion of the edge layer.

According to another aspect of the present invention, there is provided a cleaning blade comprising: an edge layer which includes an edge portion and which is formed of a first resin material; and a base layer which supports the edge layer and which is formed of a second resin material different from the first resin material, wherein a portion which is a part of the edge layer including the edge portion and which extends from a surface of the edge layer and does not reach the base layer is subjected to hardening so as to be harder than another portion of the edge layer.

Further features of the present invention will become apparent from the following description of exemplary embodiments with reference to the attached drawings.

DESCRIPTION OF THE EMBODIMENTS

First Embodiment

Figure 1:
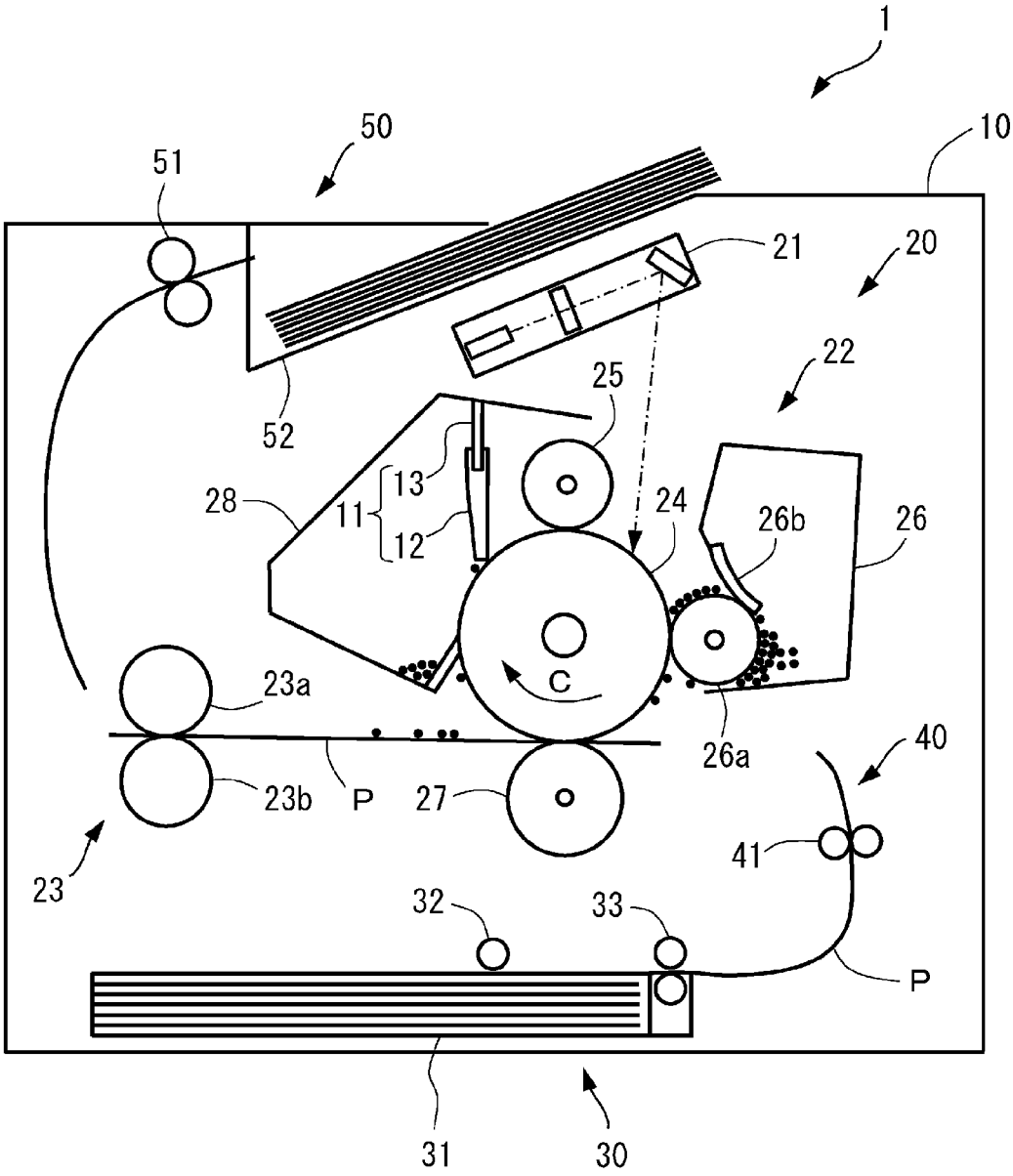
FIG. 1 is a schematic illustration of an image forming apparatus according to a first embodiment of the present invention.
Figure 2:
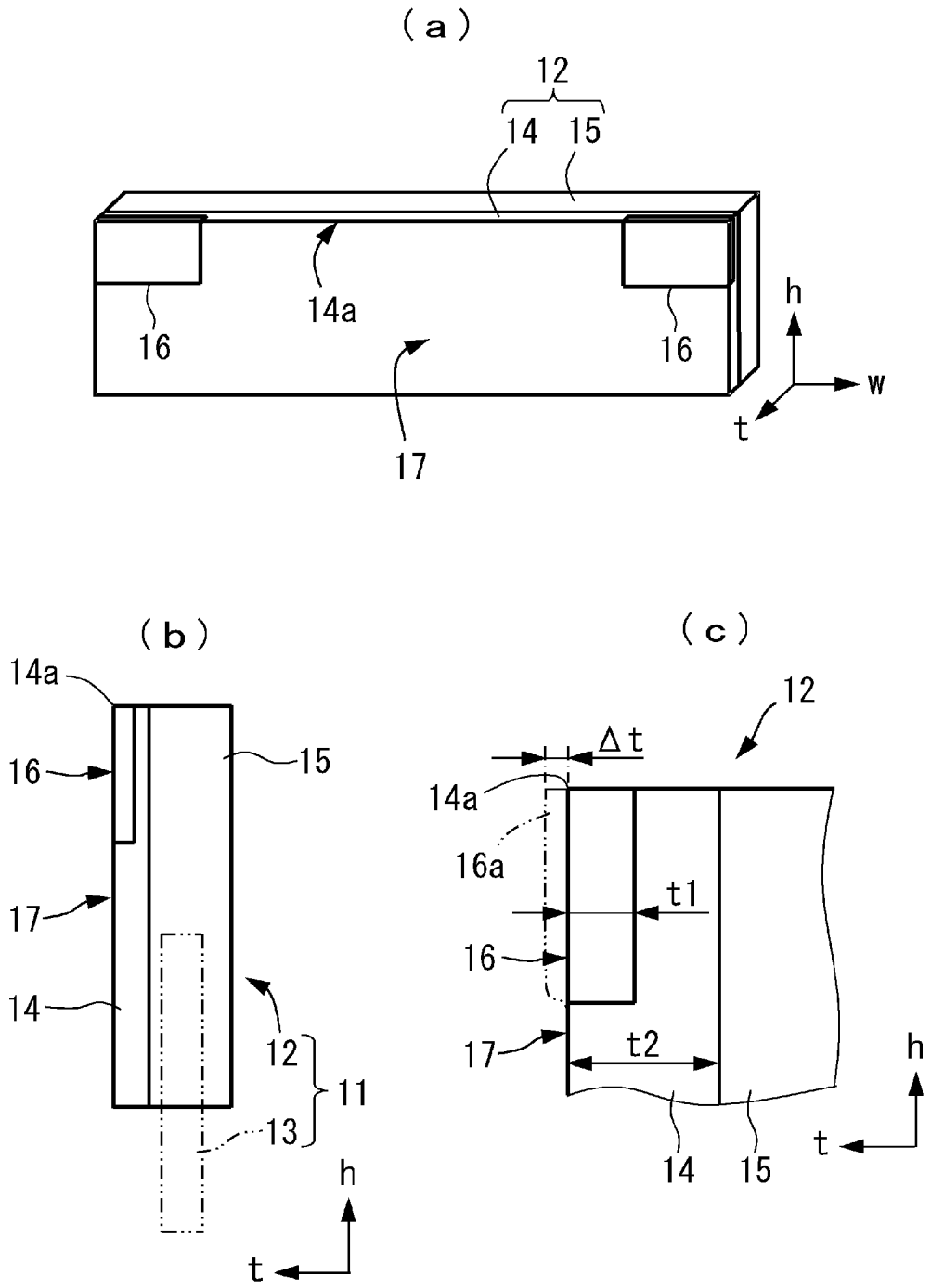
In FIG. 2, (a) to (c) are schematic illustrations each showing a cleaning blade used in the image forming apparatus according to the first embodiment of the present invention, wherein (a) is a perspective view as seen from a front side, (b) is a side view, and (c) is a partly enlarged view of the side view.
Figure 3:
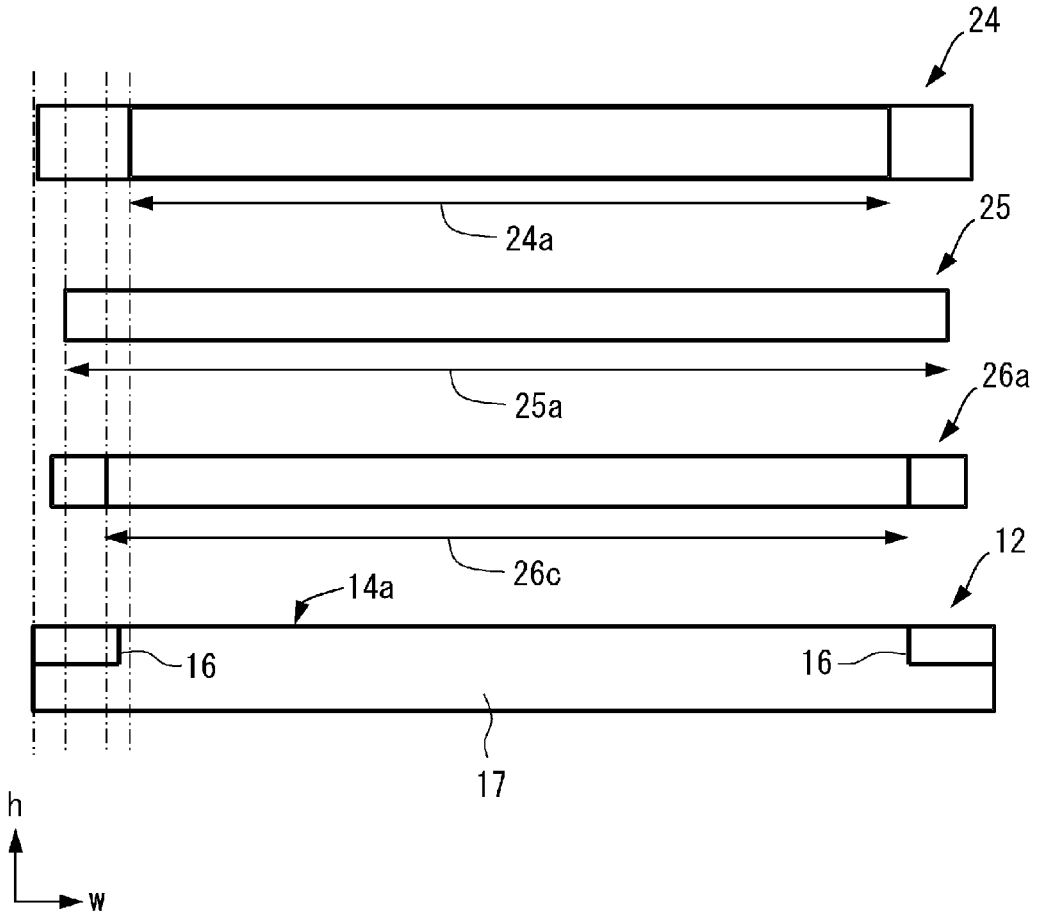
FIG. 3 is an illustration showing a position of formation of a hardened portion of the cleaning blade of the image forming apparatus according to the first embodiment of the present invention.

Referring to FIGS. 1-3, the first embodiment will be described in detail. In this embodiment, an example of an image forming apparatus is a monochromatic laser beam printer of an electrophotographic type. However, the image forming apparatus of the present invention is not restricted to such a monochromatic laser beam printer, but is applicable to also a full color printer of an intermediary transfer tandem type, for example.

As shown in FIG. 1, the image forming apparatus 1 comprises a main assembly 10 which includes an image forming station 20, a sheet feeding portion 30, a sheet feeding (conveying) portion 40, a sheet discharging portion 50 and a controller (unshown).

The image forming station 20 comprises a laser scanner 21, a process cartridge 22, a transfer roller 27 and a fixing device 23 to effect image formation. The process cartridge 22 is detachably mountable relative to the main assembly 10.

The laser scanner 21 is an exposure means for forming an electrostatic latent image on a surface of a photosensitive drum 24 by exposing the surface of the photosensitive drum 24 which will be described hereinafter. The laser scanner 21 outputs a laser beam modulated in accordance with an image signal sent from the controller of the image forming apparatus 1. It scans a uniformly charged surface of the photosensitive drum 24 (image exposure). The potential of the exposed portion of the surface of the photosensitive drum 24 lowers compared with a charge potential, so that the electrostatic latent image is sequentially formed in accordance with image information.

The process cartridge 22 includes the photosensitive drum 24 which is a rotatable image bearing member for forming a toner image, a charging roller 25, a developing device 26 and a cleaning device 28.

The photosensitive drum 24 is an organic photosensitive member having a negative charging property and is rotated at a predetermined peripheral speed in the direction indicated by an arrow C by a driving motor (unshown). The photosensitive drum 24 is subjected to uniform charging by the charging roller 25 during the rotation thereof by which it is uniformly charged to a predetermined negative potential. The charging roller 25 is rotated by the photosensitive drum 24. The charging roller 25 is supplied with a bias voltage from a charging bias voltage source (unshown) to uniformly charge the surface of the photosensitive drum 24.

The developing device 26 as a developing means includes a developing roller 26*a* and a toner layer thickness regulating member 26*b*, and in this embodiment, the toner is supplied to the electrostatic latent image formed on the photosensitive drum 24 to visualize the electrostatic latent image into a toner image through a so-called jumping development system. More particularly, a developing bias voltage comprising an AC and DC components is applied to the developing roller 26*a* from a developing bias voltage source (unshown). At a position where the toner layer thickness regulating member 26*b* and the developing roller 26*a* are in contact with each other, the toner having been triboelectrically charged to the negative polarity is supplied into the electrostatic latent image on the surface of the photosensitive drum 24, by which the electrostatic latent image is reversely developed.

The transfer roller 27 as a transferring means is urged toward a center of the photosensitive drum 24 by an urging spring (unshown). When a recording material P is fed and then a transfer step is started, a positive transfer bias voltage is applied to the transfer roller 27 from a transfer bias voltage source (unshown), so that the toner on the photosensitive drum 24 charged to the negative polarity is transferred onto the recording material P. That is, the transfer roller 27 transfers the toner image from the photosensitive drum 24 onto the recording material (another image bearing member) P.

The cleaning device 28 includes a cleaning member 11 and scrapes off residual toner remaining on the surface of the photosensitive drum 24 after the image transfer to clean the surface of the photosensitive drum 24, so that the surface of the photosensitive drum 24 prepares is repeatedly subjected to image formation. The cleaning member 11 includes a cleaning blade 12 of an elastic rubber, and a supporting member 13 in the form of a metal plate supporting the cleaning blade 12. The cleaning blade 12 contacts an edge portion 14*a* thereof which will be described hereinafter to the photosensitive drum 24 over the length of the photosensitive drum at a predetermined pressure. The edge portion 14*a* of the cleaning blade 12 removes the residual toner, so that the surface of the photosensitive drum 24 is cleaned. The cleaning blade 12 is contacted to the surface of the photosensitive drum 24 at the edge portion 14*a* counterdirectionally with respect to the rotational direction of the surface of the photosensitive drum 24, i.e., with an urging angle where the edge portion 14*a* is urged against the surface of the photosensitive drum 24. Thus, the cleaning blade 12 contacts to the photosensitive drum 24 at the position after the toner image transferred by the transfer roller 27, so that it removes the residual toner from the photosensitive drum 24. After an end of the cleaning step by the cleaning blade 12, the surface of the photosensitive drum 24 is again subjected to the charging step. The structure of the cleaning blade 12 will be described in detail hereinafter.

The fixing device 23 includes a fixing roller 23*a* and a pressing roller 23*b*. The recording material P is nipped and fed between the fixing roller 23*a* and the pressing roller 23*b*, during which the toner image transferred onto the recording material P is pressed and heated to be fused and fixed on the recording material P.

The sheet feeding portion 30 is disposed in a lower position of the main assembly 10 and includes a sheet feeding cassette 31, a pick-up roller 32 and feeding rollers 33. It feeds the recording material P which may be a sheet of paper, an OHP sheet stacked on the sheet feeding cassette 31 to the image forming station 20. The pick-up roller 32 and feeding rollers 33 function to separate and feed the recording material P one by one from the top of the stack on the sheet feeding cassette 31 in timed relationship with the image forming operation.

The sheet feeding portion 40 feeds the recording material P fed from the sheet feeding portion 30 to the sheet discharging portion 50 through registration rollers 41 and the image forming station 20. The registration rollers 41 once stop the recording material P to correct inclination of the recording material P. More particularly, by the recording material P being stopped by the registration rollers 41, a loop of the recording material P is formed by which the leading edge of the recording material P is rectified. In addition, the registration rollers 41 feed the recording material P to a transfer portion between the photosensitive drum 24 and the transfer roller 27 at timing when the image is formed on the recording material P, i.e., or at timing based on timing when the toner image is carried on the photosensitive drum 24.

The sheet discharging portion 50 includes discharging rollers 51 and a discharging tray 52 and discharges the recording material P fed by the sheet feeding portion 40 after the fixing process onto the discharging tray 52 by drive of the discharging rollers 51.

The controller (unshown) includes a computer which includes a CPU, a ROM storing a program for controlling various parts, a RAM temporarily storing data, for example. The controller is connected with the image forming station 20, the sheet feeding portion 30, the sheet feeding portion 40 and the sheet discharging portion 50 to control operations of various parts of the apparatus. The controller is such that an operator can operate and set various parameters and instructions from a computer (unshown) connected with the main assembly 10, or on an operation panel (unshown).

An image forming operation of the image forming apparatus 1 having the above-described the structures will be described.

As shown in FIG. 1, when the image forming operation it started, the photosensitive drum 24 rotates, and the surface thereof is electrically charged by the charging roller 25. The laser beam is generated in accordance with the image information and is projected onto the photosensitive drum 24 by the laser scanner 21 to form the electrostatic latent image on the surface of the photosensitive drum 24. The thus formed electrostatic latent image is developed into a visualized toner image by the properly charged toner being supplied onto the surface of the photosensitive drum 24 by the developing device 26.

On the other hand, concurrently with the toner image forming operation, the pick-up roller 32 and the feeding rollers 33 are rotated to feed the topmost recording material P out of the sheet feeding cassette 31 while separating the topmost recording material P. In synchronism with the formation of the toner image on the photosensitive drum 24, the recording material P is supplied into the transfer portion between the photosensitive drum 24 and the transfer roller 27 by the registration rollers 41. The toner image is transferred from the photosensitive drum 24 onto the recording material P, and the recording material P is fed into a fixing nip between the fixing roller 23*a* and the pressing roller 23*b* of the fixing device 23, where the unfixed toner image is heated and pressed to be fixed on the surface of the recording material P, and then the recording material P is discharged.

Referring to FIG. 2, the cleaning member 11 will be described. As shown in FIG. 2 and so on, in this embodiment, the direction of a thickness of the plate member constituting the cleaning blade 12 is called a thickness direction t, and the direction parallel with a rotational axis direction of the photosensitive drum 24 is called a widthwise direction w. In FIG. 2 and so on, the direction perpendicular to the thickness direction t and to the widthwise direction w toward the photosensitive drum 24 is called an extension direction (height direction) h.

As shown in FIG. 1 and (b) of FIG. 2, the cleaning member 11 is produced into an integral molding comprising an elongated supporting member 13 of metal and the cleaning blade 12. As shown in FIG. 2, the cleaning blade 12 has a two-layer-structure including an edge layer 14 and a base layer (back-up layer) 15. The edge layer 14 includes an edge portion 14*a* contactable to the photosensitive drum 24 and is made of a polyurethane resin material (first resin material) having a low impact resilience. The base layer 15 is in an overlapping relation with the edge layer 14 in the thickness direction t of the cleaning blade 12 to support the edge layer 14. The base layer 15 is made of a polyurethane resin material (second resin material) which is different from the low impact resilience polyurethane resin material and which has a high impact resilience. The whole thickness of the cleaning blade 12 is 2 mm, for example.

By using the low impact resilience material for the edge layer 14, a removing effect of removing a deposited matter resulting from filming of an external additive or the like contained in the toner and/or a deposited matter due to the fusing of the toner on the photosensitive drum 24 can be improved. The reason for the improvement in the removing effect on the deposited matter is that when the edge portion 14*a* of the cleaning blade 12 contacts the deposited matter, the edge portion 14*a* is not easily deformed because of the low impact resilience.

By using the high impact resilience material for the base layer 15, a natural elastic effect of the cleaning blade 12 can be achieved. That is, a stabilized contact state can be maintained against a change such as rise of the frictional force of the surface of the photosensitive drum 24 or the like, and beating and/or noising of the cleaning blade 12 which may occur in the long-term operation can be suppressed.

The materials of the edge layer 14 and the base layer 15 may be a polyisocyanate compound and a multifunctional active hydrogen compound. The polyisocyanate compound is preferably a pre-polymer or a semi-prepolymer obtained by reaction of a normal polyisocyanate with a polymeric polyol which is the multifunctional active hydrogen compound. An isocyanate group content (NCO %) of the pre-polymer or semi-prepolymer is preferably 5-20 mass % in order to realize a satisfactory elastic property. The isocyanate group content (NCO %) is a mass % of the isocyanate functional group (NCO, molecular weight of 42) contained in the pre-polymer or semi-prepolymer which is a base material of the polyurethane resin material.

Specific examples of ordinary polyisocyanate for the preparation of the pre-polymer or semi-prepolymer are as follows. The examples include diphenylmethane diisocyanate (MDI), trylene diisocyanate (TDI), naphthalene diisocyanate (NDI), hexamethylene diisocyanate (HDI) or the like. Specific examples of the polymeric polyol which is the active hydrogen compound for preparing the pre-polymer or the semi-prepolymer are as follows. They are a polyester polyol, a polyether polyol, a caprolactoneester polyol, a polycarbonateester polyol, a silicone polyol or the like. A weight average molecular weight thereof is preferably 500-5000.

Specific examples of crosslinking agent include 1,4-butanediol, 1,6-hexane diol, ethylene glycol, trimethylol propane or the like. In the reaction of the polymeric polyol, the polyisocyanate and the crosslinking agent, an ordinary catalyst used in formation of the polyurethane resin material can be added. Specific examples of the catalyst may be triethylenediamine or the like.

In the molding method of the cleaning blade 12 formed of the polyurethane resin material in this embodiment, the polymeric polyol, the polyisocyanate, the crosslinking agent, the catalyst and so on are mixed all together, and are casted by a metal mold. At this time, in order to mold the cleaning blade 12 of the polyurethane resin material directly on the supporting member 13 to improve the accuracy at the contact portion relative to the photosensitive drum 24, the cleaning blade 12 formed of the polyurethane resin material is cut at a free end portion.

By blending of the various components of the above-described polyurethane resin material, the impact resilience can be properly adjusted. Therefore, the polyurethane resin material is properly selected so that the edge layer 14 and base layer are given the proper impact resiliences, respectively.

At the initial stage of the use of the cleaning blade 12, the frictional force relative to the photosensitive drum 24 is large in the edge portion 14*a* which has not been subjected to a hardening (treatment) which will be described hereinafter. Therefore, it is preferable to apply a lubricant on the entire area of the cleaning blade 12 with respect to the widthwise direction w in order to suppress everting of the cleaning blade 12. An example of the lubricant is hydrofluoro ether (HFE) in which 10% by weight of graphite fluoride having an average particle size of 3 μm (tradename: "CEFBON", available from Central Glass Co., Ltd) is dispersed. This is applied to the cleaning blade 12 and then is dried, by which the frictional force relative to the photosensitive drum 24 can be reduced.

A manufacturing method for the cleaning member 11 having such a structure will be described.

As for the method of integral formation of the two-layer-structure including the edge layer 14 and the base layer 15, a continuously molding method (e.g., Japanese Laid-open Patent Application 2007-30385) is known in which a rotation molding drum provided with a groove in the outer periphery thereof is used. In the basic manufacturing method thereof, a sheet of elastic rubber of a synthetic resin material having a width which is the same as or little larger than a width of a tape is continuously produced, and the produced elongated sheet is cut into the predetermined size. It is connected with a one side edge of the metal supporting member 13 to produce the cleaning blade 12.

In the fundamental manufacturing means used with the manufacturing method, the molding drum provided with an outer periphery molding groove is rotated about a horizontal shaft, during which a liquid raw material such as the polyurethane is continuously injected into the molding groove from a neighborhood of the apex, and the material is polymerized during the rotation of the molding drum. The continuous molding product of the polyurethane or the like in the form of an elongated sheet is peeled at the position before the injecting position, and it is subjected to a post-processing. With this method, a molded material in the form of the elongated sheet is continuously produced, and therefore, in the post-processing, the operation of cutting the material into individual cleaning blade 12 having a predetermined shape and the connecting operation to the supporting member 13 can be continuously carried out, and therefore, there is no needless operation and the productivity is high.

In this continuous molding method, a plurality of injecting machines are used. By continuously supplying the polyurethane resin materials having the different compositions from the respective injecting machines into the molding groove of the molding drum, a cleaning blade 12 comprising two polyurethane resin material layers having the different impact resiliences can be produced. When the injection openings are positioned one after the other relative to the molding groove of the continuously rotating molding drum, the polyurethane resin material injected afterword coats the first injected polyurethane resin material. In this state, the polyurethane resin materials are hardened (cured), so that the layers are formed. The position, the width and the thickness of the edge layer 14 can be controlled by selecting the position of the first injected polyurethane resin material, the supply amount thereof, composition and/or kind of the synthetic resin material, the rotation speed of the molding drum and so on. The amount of the afterword supplied synthetic resin material is enough to fill the entirety to provide the base layer 15. Thereafter, it is preferable to cut out the free end portion of the cleaning blade 12 for the purpose of precise contact of the edge portion 14*a* to the surface of the photosensitive drum 24.

A hardened portion 16 of the cleaning blade 12 used in the image forming apparatus 1 of this embodiment will be described in detail.

As shown in FIG. 2, the cleaning blade 12 includes, in a part of the edge layer 14 including the edge portion 14*a*, the hardened portion 16 having been subjected to the hardening for enhancing the hardness as compared with the other portion of the edge layer 14. The hardened portion 16 is provided at each of the opposite end portions of the edge layer 14 with respect to the widthwise direction w.

As shown in FIG. 3, the photosensitive drum 24 has an image forming region 24*a* in which the image formation is capable. The developing roller 26*a* has a developer carryable region (toner coated region) 26*c* capable of carrying the toner, which region covers the image forming region 24*a* to make the image forming region 24*a* developable. In order to electrically charge the toner coated region 26*c*, the charging roller 25 has a charging region 25*a* capable of charging the area covering the toner coated region 26*c*.

However, outside the widthwise range corresponding to the charging region 25*a* of the photosensitive drum 24, there is a possibility that a slight amount of the toner is deposited on the photosensitive drum 24. For this reason, the cleaning blade 12 is long enough to cover the entirety of the widthwise range of the photosensitive drum 24. The hardened portion 16 extends from an inner widthwise edge (with respect to the widthwise direction w) which is outside the image forming region 24*a* (with respect to the widthwise direction w) and which overlaps the toner coated region 26*c*, to the distal end with respect to the widthwise direction w.

In this embodiment, the hardened portion 16 is formed by the hardening in which the portion to be hardened is impregnated with the isocyanate compound. A specific processing procedure is as follows, for example. In this embodiment, as the hardening, a processing method in which the cleaning blade 12 is impregnated with the isocyanate compound is employed, but the present invention is not restricted to the processing method.

(1) a step (contact step) of contacting the isocyanate compound to the opposite end portions of the cleaning blade 12 of the polyurethane resin material with respect to the widthwise direction w of the cleaning blade 12.

(2) a step (impregnation step) of impregnating the cleaning blade 12 with the isocyanate compound in a state in which the isocyanate compound is contacted to the surface of the cleaning blade 12.

(3) a step (removal step) of removing the isocyanate compound remaining on the surface of the cleaning blade 12 after the impregnation.

(4) a step (forming step) of forming the hardened portion 16 by forming an allophanate bond by reacting the isocyanate compound with which the cleaning blade 12 is impregnated.

In the contact step and the impregnation step, each of the opposite end portions of the cleaning blade 12 with respect to the widthwise direction w thereof is impregnated with the isocyanate compound in a proper amount. In the polyurethane resin material forming into the cleaning blade 12, an urethane bond having an active hydrogen is present.

As the isocyanate compound with which the cleaning blade 12 is impregnated, it is possible to use the isocyanate compound having one isocyanate group in one molecule, or the isocyanate compound having two or more isocyanate groups in one molecule.

As the isocyanate compound having one isocyanate group in one molecule, it is possible to use an aliphatic monoisocyanate such as octadecy isocyanate (ODI), and an aromatic monoisocyanate groups in one molecule, having two or more isocyanate groups in one molecule, with which the cleaning blade 12 is impregnated, it is possible to use 2,4-trylene diisocyanate, 2,6-trylene diisocyanate, and the like. In addition, it is possible to use 4,4'-diphenylmethane diisocyanate (MDI)-, m-phenylene diisocyanate, and the like. Further, it is possible to use tetramethylene diisocyanate, hexamethylene diisocyanate, and the like.

In order to accelerate the reaction of the isocyanate compound, it is possible to impregnate the polyurethane resin material with the catalyst in addition to the isocyanate compound. Examples of the catalyst used together with the isocyanate compound include a quaternary ammonium salt, a carboxylate and the like. As the quaternary ammonium salt, it is possible to use "DABCO registered trademark)" TMR catalyst and the like. As the carboxylate, it is possible to use potassium acetate, potassium octylate, and the like. These catalysts can be very viscous or in the form of a solid during the impregnation, and therefore it is preferable that the catalyst dissolved in a solvent in advance is added into the isocyanate compound and then the polyurethane resin material is impregnated with the resultant isocyanate compound.

The impregnation of the cleaning blade 12 with the isocyanate compound can be performed by, e.g., a method in which a fibrous member or a porous member is impregnated with the isocyanate compound and then is applied onto the cleaning blade 12 or a method in which the member is spray-coated on the cleaning blade 12, or the like method.

Figure 7:
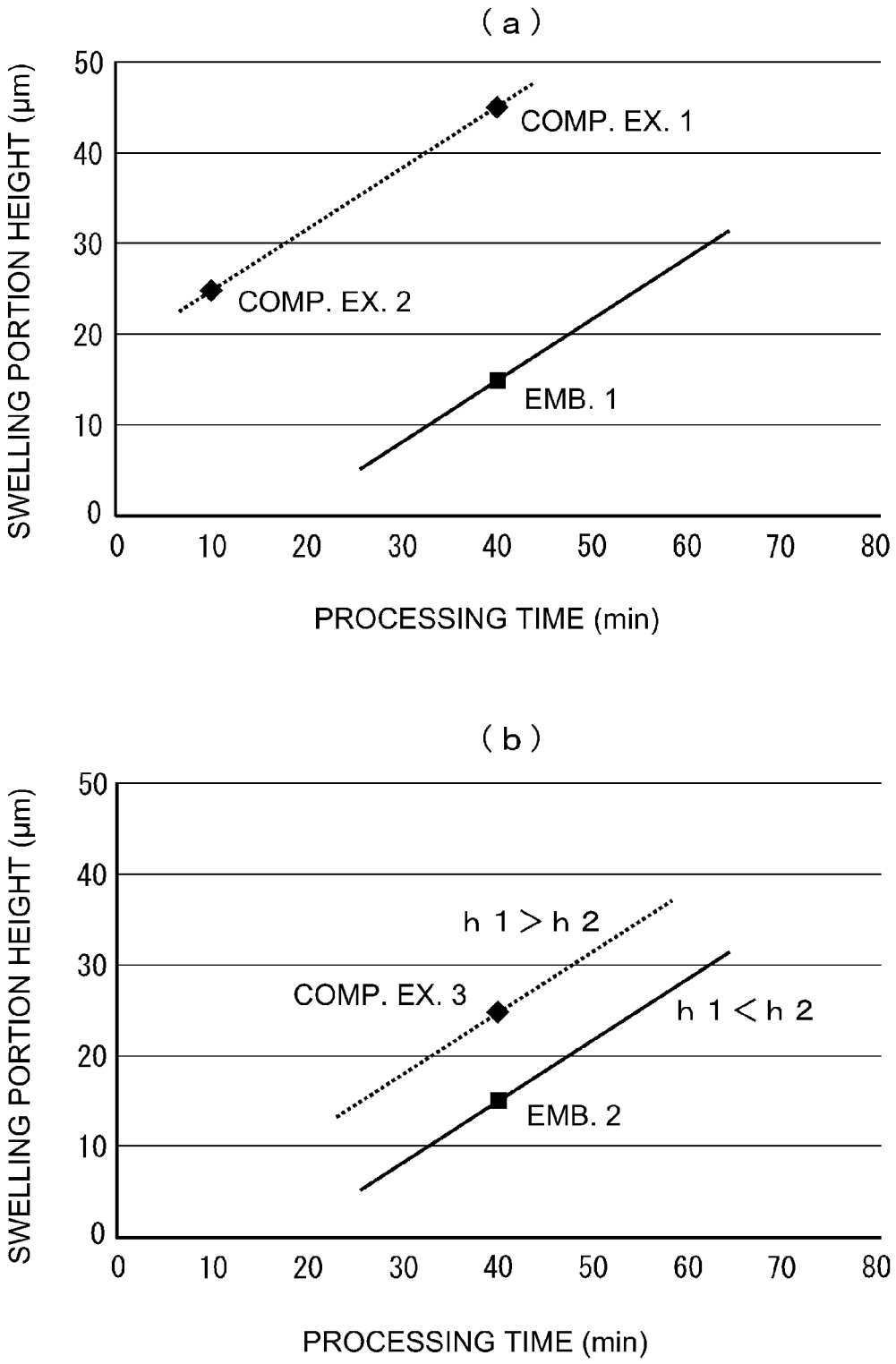
In FIG. 7, (a) and (b) are graphs each showing a relationship between a processing time of hardening treatment to the cleaning blade and a height of a swelled (swelling) portion of the cleaning blade, wherein (a) is for the first embodiment, and (b) is for the second embodiment.

In the contact step and the impregnation step, the cleaning blade 12 is impregnated with the isocyanate compound for a predetermined time. In order to bring the hardness of the finally obtained hardened portion 16 into a range effective in suppressing the everting of the cleaning blade 12, a contact time between the isocyanate compound and the cleaning blade 12 is preferably 30 minutes or more, for example (FIG. 7). The contact time is preferably 55 minutes or less, for example, in order to bring the hardness of the hardened portion 16 into a range effective in suppressing slip-through of the toner. When mass-productivity is taken into consideration, the contact time is further preferably 40 minutes or less, for example. These contact times are examples, and may appropriately be changed depending on a dimension, a shape, a material, and the like which are required for the cleaning blade 12.

In this embodiment, a length t2 of the edge layer 14 in the thickness direction t is desirably 100-300 μm, for example, and in this embodiment, the length t2 is 200 μm, for example. Further, a length t1 of the hardened portion 16 in the thickness direction t is 100 μm, for example.

In this embodiment, a dynamic hardness difference which is a difference between a dynamic hardness DH of the hardened portion 16 of the edge layer 14 and a dynamic hardness DH of a region 17 other than the hardened portion 16 is 0.05 mN/(μm×μm) or more an 0.30 mN/(μm×μm) or less. The dynamic hardness difference is preferably 0.07 mN/(μm×μm) or more and 0.27 mN/(μm×μm) or less. These numerical ranges are examples, and therefore may also be those outside the above ranges under some conditions. The dynamic hardness DH is defined as: $DH=\alpha\times P/d^2$, where P is a load (mN), D is a pressing depth (μm) of a penetrator into a sample, and α is a constant depending on a shape of the penetrator (α=3.8584). Further, measurement under a hardness measuring condition is made using, e.g., a measuring device ("FISCHERSCOPE HM2000LT", manufactured by Fischer Instruments K.K.) and a measuring penetrator ("HN2000 060", manufactured by Fischer Instruments K.K.). An example of the measure condition is 10 mN in measuring load, 20 sec in load increasing time, 5 sec in creep time, 20 sec in load decreasing time, and 5 sec in creep time.

In the removal step, the isocyanate compound remaining on the surface of the cleaning blade 12 is removed by being wiped with a solvent capable of dissolving the isocyanate compound. When the removal of the isocyanate compound excessively remaining on the surface of the cleaning blade 12 after the impregnation is not effected uniformly, minute projected portions are formed on the surface of the hardened portion 16, with the possible result that the toner slips through the projected portions when the residual toner is removed. Therefore, there is a need to perform a step of sufficiently remove the isocyanate compound deposited on the surface of the cleaning blade 12 with use of the solvent capable of dissolving the isocyanate compound. As the solvent usable in the removal step, it is possible to use, e.g., toluene, xylene, butyl acetate, methyl ethyl ketone, and the like. As a means for removing the isocyanate compound, it is possible to use, e.g., a method in which a sponge or the like having a hardness to the extent that the sponge does not damage the cleaning blade 12 formed of the polyurethane resin material is impregnated with the above-described solvent in a small amount and then an excessive isocyanate compound deposited on the surface of the cleaning blade 12 is wiped off with the sponge.

In the forming step after the steps described above, the isocyanate compound with which the cleaning blade 12 is impregnated reacts with the urethane resin to form the allophanate bond or reacts with moisture in the air to be almost consumed, so that a white-opaque hardened portion 16 having a high hardness is formed. Thus, it is possible to obtain the cleaning blade 12 having a smooth surface. Further, it would be considered that also an origomerizing reaction (e.g., carbodiimidizing, isocyanurate-forming reaction) concurrently proceeds and contributes to the formation of the hardened portion 16. As a result, it would be considered that the hardness of the hardened portion 16 is improved and a friction coefficient lowers and thus a durability of the cleaning blade 12 can be improved.

In some cases, the hardened portion 16 prepared by the above-described stepped portions forms a swelled portion 16*a* where the hardened portion 16 is swelled in the thickness direction t of the cleaning blade 12. There is liability that the hardened portion 16 is swelled to generate a stepped portion between the swelled portion 16*a* and the region 17 other than the hardened portion 16 of the edge layer 14 and thus the toner slips through the stepped portion, and therefore it is desirable that an application condition for suppressing the generation of the stepped portion to the possible extent is employed.

When a height Δt of the swelled portion 16*a*, i.e., a difference in thickness of the cleaning blade 12 at the stepped portion is, e.g., 25 μm or less, slip-through of the toner can be effectively suppressed.

In this embodiment, the isocyanate compound is applied on the surface of the edge layer 14 of the cleaning blade 12, so that the edge layer 14 is impregnated with the applied isocyanate compound in the thickness direction t. As a result, compared with the case where the isocyanate compound is applied on an end (edge) surface of the cleaning blade 12 (FIG. 6), only the edge layer 14 can be impregnated with the isocyanate compound, and therefore the stepped portion between the hardened portion 16 (the swelled portion 16*a*) and the region 17 (other than the hardened portion 16) can be made small ((a) of FIG. 7).

The reason why the stepped portion becomes large in the case where the isocyanate compound is applied on the end surface of the cleaning blade 12 results from a difference in physical property between the edge layer 14 and the base layer 15. That is, for the edge layer 14, a rubber having a low impact resilience is used in order to enhance a deposited matter removing performance. Compared with a rubber which has a high impact resilience and which is used for the base layer 15, the rubber having the low impact resilience requires a long time for reaction by the isocyanate compound, so that a long processing time is needed. For this reason, in the case where the cleaning blade 12 is impregnated with the isocyanate compound at the end surface, both of the edge layer 14 and the base layer 15 react with the isocyanate compound. As a result, in the case where the edge layer 14 is processed (treated) for a necessary time (e.g., 30 minutes), in the base layer 15, the reaction sufficiently proceeds, and therefore a possibility that the large stepped portion generates at the edge layer 14 by the influence of the swelling of the base layer 15 is suggested.

In this embodiment, a length t1 of the hardened portion 16 with respect to the thickness direction t is made shorter than a length t2 of the edge layer 14 with respect to the thickness direction t, and a portion which is a part of the edge layer 14 including the edge portion 14*a* and which does not reach the base layer 15 from a surface of the edge layer 14 is subjected to the hardening. As a result, compared with the case where a portion extending from the surface of the edge layer 14 to reach the base layer 15 of the cleaning blade 12 is subjected to the hardening (t1>t2, FIG. 6), the swelling of the base layer 15 can be suppressed. For this reason, the stepped portion between the hardened portion 16 and the region 17 other than the hardened portion 16 can be made small, so that the prevention of the everting of the cleaning blade 12 and the prevention of the slip-through of the toner can be compatibly realized.

As described above, according to the cleaning blade 12 of the image forming apparatus 1 in this embodiment, the portion which is the part of the edge layer 14 including the edge portion 14*a* and which does not reach the base layer 15 from the surface of the edge layer 14 is subjected to the hardening so that only the edge layer 14 can be subjected to the hardening. For this reason, different from the case where the hardening is made in a range from the edge layer 14 to the base layer 15, the base layer 15 different in physical property from the edge layer 14 is not subjected to the hardening, and therefore the swelling at the edge portion 14*a* can be suppressed. As a result, the stepped portion between the hardened portion 16 subjected to the hardening and the region 17 other than the hardened portion 16 can be made small, and therefore the slip-through of the toner is suppressed, so that it is possible to compatibly realize prevention of the everting of the cleaning blade 12 and prevention of the slip-through of the toner.

Second Embodiment

Second Embodiment of the present invention will be described in detail with reference to FIGS. 4 and 5. In this embodiment, compared with First Embodiment, shapes of an edge layer 114 and a base layer 115 of a cleaning blade 112 of a cleaning member 111 are different. Correspondingly thereto, also shapes of a hardened portion 116 and a region 117 other than the hardened portion 116 are different. Other constitutions are similar to those in First Embodiment, and therefore are represented by the same reference numerals or symbols and will be omitted from detailed description.

Figure 4:
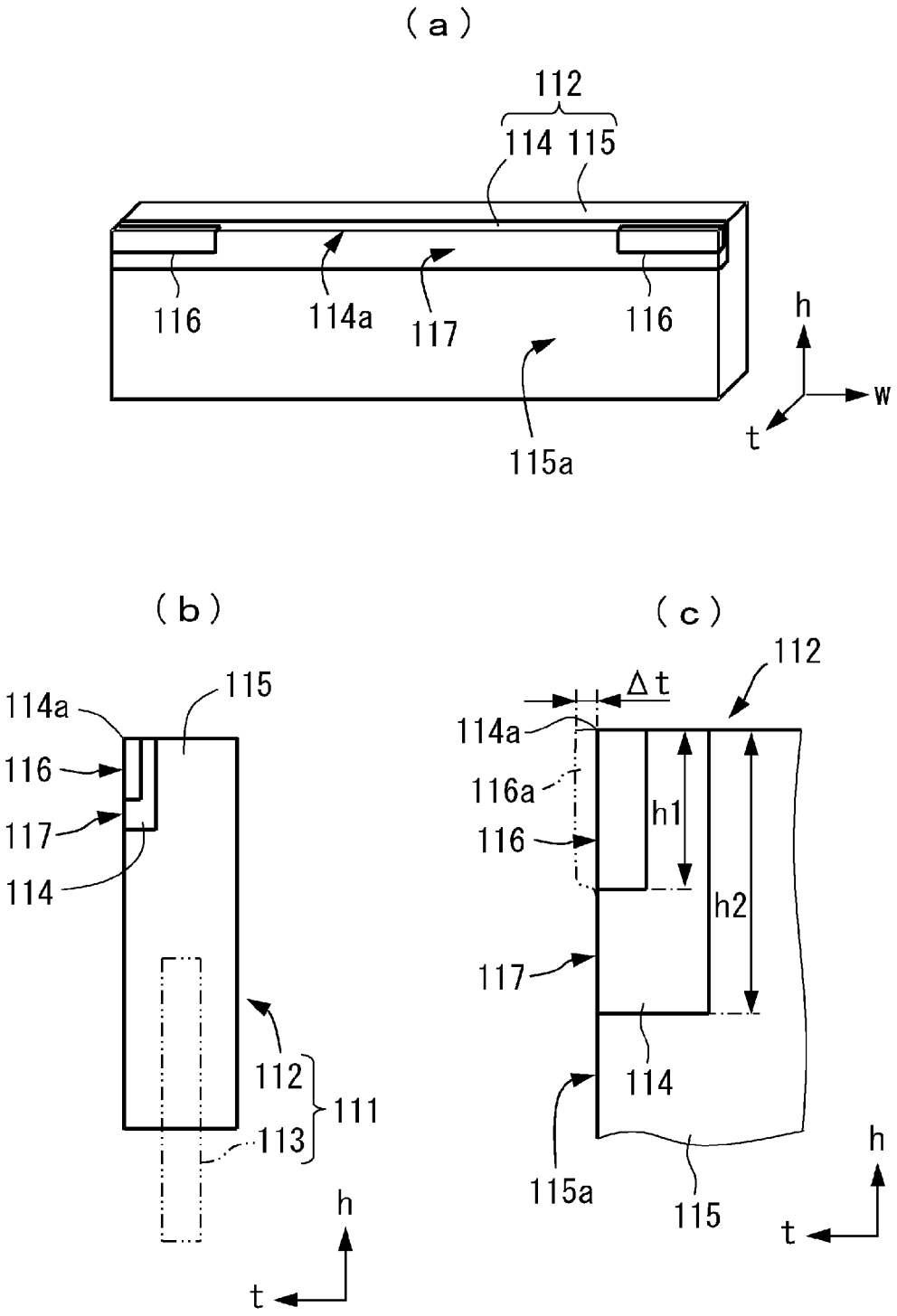
In FIG. 4, (a) to (c) are schematic illustrations each showing a cleaning blade used in the image forming apparatus according to a second embodiment of the present invention, wherein (a) is a perspective view as seen from a front side, (b) is a side view, and (c) is a partly enlarged view of the side view.

As shown in FIG. 4, in this embodiment, the edge layer 114 is formed only at a part, of a side surface including an edge portion 114*a* of the cleaning blade 112, extending along the edge portion 114*a*. That is, different from First Embodiment, the edge layer 114 is not formed at the entirety of the side surface including the edge portion 114*a* of the cleaning blade 112. For this reason, at the side surface including the edge portion 114*a* of the cleaning blade 112, a part of the base layer 115 is exposed as an exposed portion 115*a*. That is, at the side surface including the edge portion 114*a* of the cleaning blade 112, the edge layer 114 and the exposed portion 115*a* of the base layer 115 are disposed adjacently to each other with respect to the extension direction h.

In this way, in the cleaning blade 112 in this embodiment, the edge layer 114 is provided only in the neighborhood of the edge portion 114*a*, and therefore function separation between the edge layer 114 and the base layer 115 can be effectively realized. That is, the cleaning blade 112 has the function of the edge layer 114 for removing the toner and the function of the base layer 115 for stabilizing behavior of the entirety of the blade, and a rubber composition suitable for each of the functions is selected. In the cleaning blade 112 in this embodiment, each of the regions consisting of the edge layer 114 and the base layer 115 is made more restrictive, so that each of the functions can be effectively achieved.

A length h2 of the edge layer 114 with respect to the extension direction h may desirably be 2-4 mm, for example, and in this embodiment, the length h2 is 3 mm, for example. A length h1 of the hardened portion 116 with respect to the extension direction h is 2.5 mm, for example. A full length of the cleaning blade 112 with respect to the extension direction h is 8 mm, for example.

When the cleaning blade 112 is formed, the position of the polyurethane resin material, the supply amount thereof, composition and/or kind of the synthetic resin material, the rotational speed of the molding drum and so on are changed, so that the position, the width and the thickness of the edge layer 114 are properly adjusted. Similarly as in First Embodiment, the afterward supplied synthetic resin material is supplied in an amount necessary to fill the entirety, so that the base layer 115 is formed. The materials for the edge layer 114 and the base layer 115 are similar to those in First Embodiment.

In some cases, the hardened portion 116 prepared as described above forms a swelled portion 116*a* where the hardened portion 116 is swelled in the thickness direction t of the cleaning blade 112. There is liability that the hardened portion 116 is swelled to generate a stepped portion between the swelled portion 116*a* and the region 117 other than the hardened portion 116 of the edge layer 114 and thus the toner slips through the stepped portion, and therefore it is desirable that an application condition for suppressing the generation of the stepped portion to the possible extent is employed.

In this embodiment, the length h1 of the hardened portion 116 with respect to the extension direction h is made shorter than the length h2 of the edge layer 114 with respect to the extension direction h. Further, the portion which is the part of the edge layer 114 including the edge portion 114*a* and which does not reach the exposed portion 115*a* of the base layer 115 from the end surface of the cleaning blade 112 with respect to the extension direction h is subjected to the hardening. As a result, compared with the case where a portion extending from the end portion of the cleaning blade 112 to reach the exposed portion 115*a* of the base layer 115 with respect to the extension direction h (h1>h2), it is possible to suppress the swelling of the base layer 115. For this reason, the stepped portion between the hardened portion 116 and the region 117 other than the hardened portion 116 can be made small ((b) of FIG. 7). For this reason, it is possible to compatibly realize the prevention of the everting of the cleaning blade 112 and the prevention of the slip-through of the toner.

Figure 5:
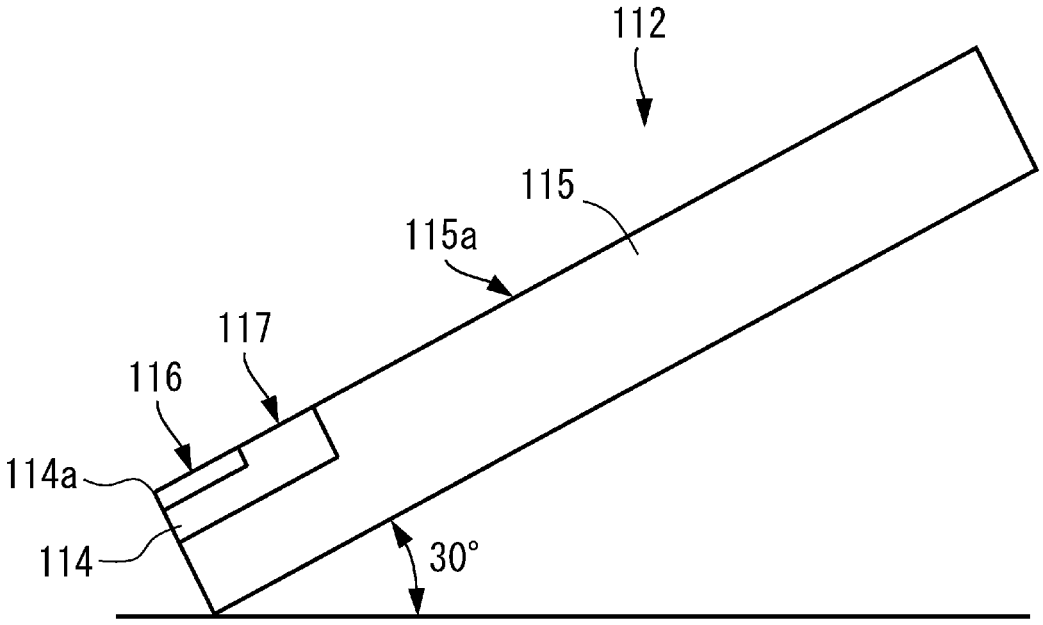
FIG. 5 is an illustration showing a state when the cleaning blade is hardened in the image forming apparatus according to the second embodiment of the present invention.

When the hardened portion 116 is formed on the cleaning blade 112, as shown in FIG. 5, it is desirable that when the cleaning blade 112 is impregnated with the isocyanate compound, the processing is performed in a state in which the cleaning blade 112 is inclined by about 30 degrees. As a result, the solution of the isocyanate compound is easily accumulated in the edge portion 114*a* side, so that the hardening in the length h1, of the hardened portion 116 with respect to the extension direction h, made shorter than the length h2 of the edge layer 114 with respect to the extension direction h can be stably effected.

As described above, according to the cleaning blade 12 of the image forming apparatus 1 in this embodiment, the portion which is the part of the edge layer 14 including the edge portion 14*a* and which does not reach the base layer 15 from the surface of the edge layer 14 is subjected to the hardening, so that only the edge layer 114 can be subjected to the hardening. For this reason, the stepped portion between the hardened portion 116 subjected to the hardening and the region 117 other than the hardened portion 116 can be made small, and therefore the slip-through of the toner is suppressed, so that it is possible to compatibly realize prevention of the everting of the cleaning blade 112 and prevention of the slip-through of the toner.

In Second Embodiment, the length of the hardened portion 116 with respect to the thickness direction t is not described, but also in this embodiment, similarly as in First Embodiment, the length t1 of the hardened portion 116 with respect to the thickness direction t is made shorter than the length t2 of the edge layer 114 with respect to the thickness direction t. For that reason, the swelling of the base layer 115 can be suppressed, and therefore the stepped portion between the hardened portion 116 and the region 117 other than the hardened portion 116 can be made small, so that it is possible to compatibly realize the prevention of the everting of the cleaning blade 112 and the prevention of the slip-through of the toner at a higher degree.

In First and Second Embodiments, as the image bearing member the photosensitive drum 24 which is a single rotatable member is used, but the present invention is not limited thereto. For example, a belt rotatably supported by a plurality of rotatable rollers may also be used as the image bearing member. In this case, with respect to the widthwise direction w, in the case where the image bearing member is the belt supported by the plurality of the rotatable rollers, the widthwise direction w is a direction parallel to rotational axis directions of the respective rotating rollers.

In First and Second Embodiments, the direct transfer type in which the toner image is directly transferred from the photosensitive drum 24 onto the recording material P was described. However, the present invention is also applicable to an intermediary transfer type in which the toner image is transferred from the photosensitive drum onto an intermediary transfer member such as an intermediary transfer belt and then is transferred from the intermediary transfer member onto the recording material. In this case, another image bearing member onto which the toner image on the image bearing member is to be transferred by the transfer means is the intermediary transfer member.

Third Embodiment

Third Embodiment of the present invention will be described in detail. In this embodiment, compared with Second Embodiment, there is a difference that the length h1 of the hardened portion 116 with respect to the extension direction h is made longer than the length h2 of the edge layer 114 with respect to the extension direction h.

In this embodiment, the hardened portion 116 is formed not only on the edge layer 114 but also a portion extending to the exposed portion 115*a* of the base layer 115 adjacent to the edge layer 114 with respect to the extension direction h. For this reason, also a part of the exposed portion 115*a* is swelled to generate a stepped portion between itself and the edge layer 114. However, the exposed portion 115*a* is sufficiently spaced from the edge portion 114*a* by the length h2 with respect to the extension direction h, and therefore the swelling of the exposed portion 115*a* does not have a large influence on the edge portion 114*a* for away from the exposed portion 115*a*. For this reason, also in this embodiment, the stepped portion between the hardened portion 116 subjected to the hardening and the region 117 other than the hardened portion 116 can be made small, and therefore the slip-through of the toner is suppressed, so that it is possible to compatibly realize prevention of the everting of the cleaning blade 112 and prevention of the slip-through of the toner.

Also in Third Embodiment, similarly as in First Embodiment, the length t1 of the hardened portion 116 with respect to the thickness direction t is made shorter than the length t2 of the edge layer 114 with respect to the thickness direction t. For that reason, the swelling of the base layer 115 can be suppressed, and therefore the stepped portion between the hardened portion 116 and the region 117 other than the hardened portion 116 can be made small, so that it is possible to compatibly realize the prevention of the everting of the cleaning blade 112 and the prevention of the slip-through of the toner at a higher degree. Other constitutions are similar to those in First and Second Embodiments.

Embodiments

Removal of the residual toner from the photosensitive drum 24 by using cleaning blades of several types, and after printing of 20000 sheets, evaluations of everting of the cleaning blade and a cleaning property of the cleaning blade were made. As the image forming apparatus, the image forming apparatus 1 in First Embodiment described above was used. The evaluation of the everting of the cleaning blade was made in a high-temperature and high-humidity (room temperature: 30° C., humidity: 80%), and the evaluation of the cleaning property was made in a low-temperature and low-humidity (room temperature: 15° C., humidity: 10%). The height Δt of the swelled portion of the edge portion of each of the cleaning blades was measured by an optical microscope. Characteristics of the edge layer and the base layer of the cleaning blades used are shown in Table 1.

TABLE 1

| | EDGE LAYER | BASE LAYER |
|---|---|---|
| HARDNESS (JIS-A) | 77° | 77° |
| IMPACT RESILIENCE | 10% | 45% |

Embodiment 1

As in First Embodiment, the hardened portion 16 was formed on the cleaning blade 12 in which the edge layer 14 and the base layer 15 were superposed as a whole (FIG. 2). The hardening was made by impregnating the cleaning blade 12 with the isocyanate compound from a side surface including the edge portion 14*a* in a proper amount. The processing time was 40 minutes in which the isocyanate compound was contacted to the cleaning blade 12 and was left standing, and the height Δt of the swelled portion 16*a* was 15 μm. The length t1 of the hardened portion 16 with respect to the thickness direction t was 100 μm, and the length t2 of the edge layer 14 with respect to the thickness direction t was 200 μm, so that t1<t2 was satisfied and thus the base layer 15 was not subjected to the hardening. A result of evaluation of this cleaning blade 12 is shown in Table 2 and (a) of FIG. 7. As shown in Table 2, there was no everting of the cleaning blade 12, and the slip-through of the toner was not observed.

TABLE 2

| | EMB. 1 | COMP. EX. 1 | COMP. EX. 2 |
|---|---|---|---|
| AD*1 | SIDE | END | END |
| PT*2 | 40 min | 40 min | 10 min. |
| BE*3 | ○ | ○ | 3000 NG |
| TST*4 | ○ | 3000 NG | ○ |

*1"AD" is the application direction. "SIDE" means from the side surface. "END" means from the end (edge) surface.
*2"PT" is the processing time (minutes).
*3"BE" is the blade everting. "○" means that no everting was observed. "3000 NG" means that the everting was observed at the time of the printing of 3000 sheets.
*4"TST" is the toner slip-through. "○" means that no slip-through of the toner was observed. "3000 NG" means that the slip-through of the toner was observed at the time of the printing of 3000 sheets.

Comparison Example 1

Figure 6:
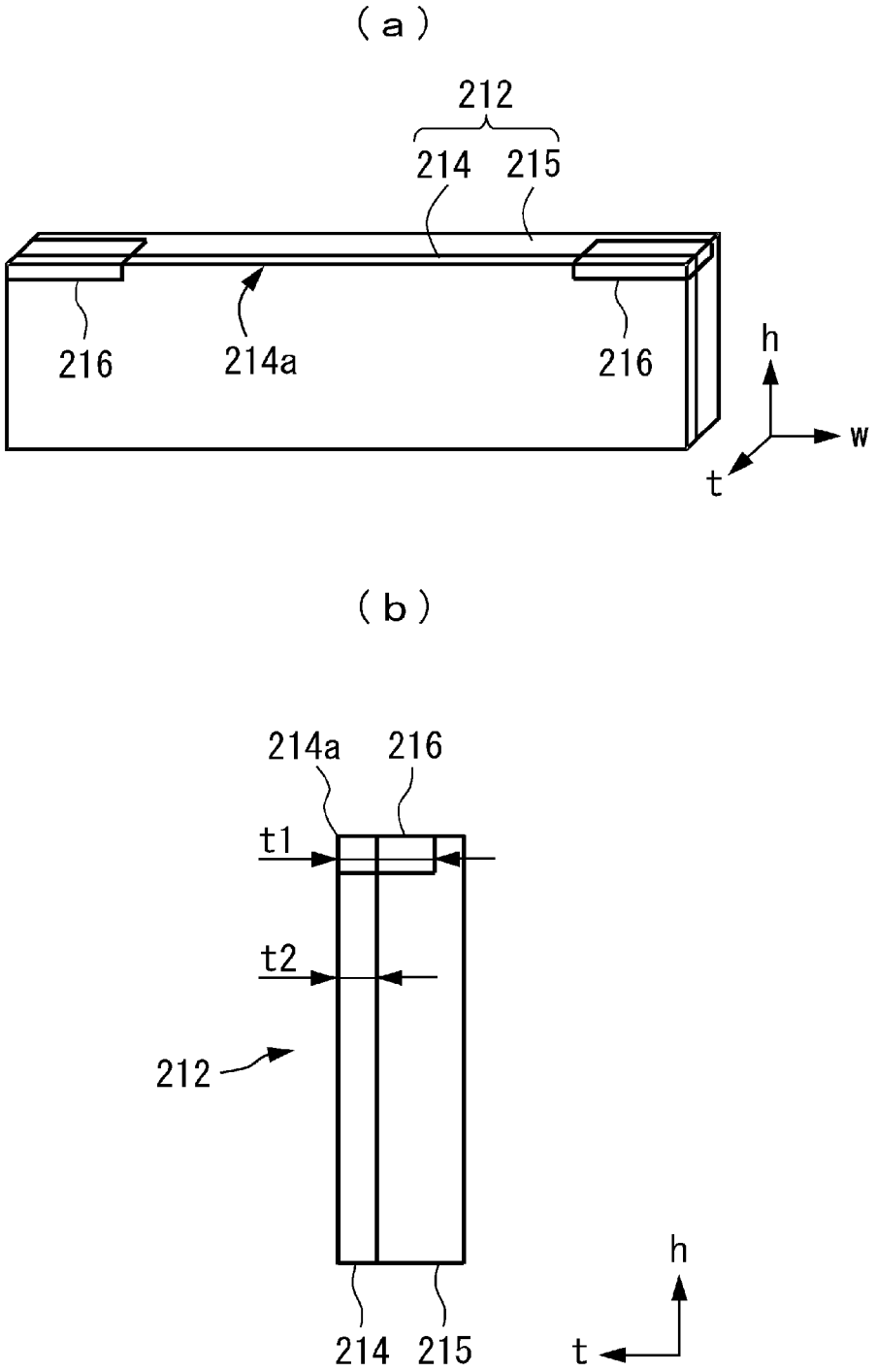
In FIG. 6, (a) and (b) are schematic illustrations each showing a cleaning blade according to a comparison example, wherein (a) is a perspective view as seen from a front side, and (b) is a side view.

As shown in FIG. 6, a hardened portion 216 was formed on a cleaning blade 212 in which an edge layer 214 and a base layer 215 were superposed as a whole (FIG. 2). The hardening was made by impregnating the cleaning blade 212 with the isocyanate compound from an end (edge) surface including an edge portion 214*a* in a proper amount. The processing time was 40 minutes in which the isocyanate compound was contacted to the cleaning blade 212 and was left standing, and the height Δt of a swelled portion was 45 μm. A relation between the length t1 of the hardened portion 216 with respect to the thickness direction t and the length t2 of the edge layer 214 with respect to the thickness direction t was t1>t2 and thus the hardened portion 216 was formed on both of the edge layer 214 and the base layer 215. A result of evaluation of this cleaning blade 212 is shown in Table 2 and (a) of FIG. 7. As shown in Table 2, with respect to the cleaning property, the slip-through of the toner was not observed at 3000 sheets.

Comparison Example 2

As shown in FIG. 6, a hardened portion 216 was formed on a cleaning blade 212 in which an edge layer 214 and a base layer 215 were superposed as a whole (FIG. 2). The hardening was made by impregnating the cleaning blade 212 with the isocyanate compound from an end (edge) surface including an edge portion 214*a* in a proper amount. The processing time was 10 minutes in which the isocyanate compound was contacted to the cleaning blade 212 and was left standing, and the height Δt of a swelled portion 16*a* was 25 μm. A relation between the length t1 of the hardened portion 216 with respect to the thickness direction t and the length t2 of the edge layer 214 with respect to the thickness direction t was t1>t2 and thus the hardened portion 216 was formed on both of the edge layer 214 and the base layer 215. A result of evaluation of this cleaning blade 212 is shown in Table 2 and (a) of FIG. 7. As shown in Table 2, the everting of the cleaning blade 212 generated at 3000 sheets.

As shown in (a) of FIG. 7, a characteristic of the cleaning blade 12 which is derived from First Embodiment and other embodiments (unshown) and on which the hardened portion 16 in Embodiment 1 is formed is shown by a solid line. A characteristic of the cleaning blade 212 which is derived from Comparison Examples 1 and 2 and on which another hardened portion 216 is formed is shown by a broken line. In either case, a degree of the hardening of the hardened portion move advances with a longer processing time, and therefore the everting of the cleaning blades 12 and 212 does not readily generate. Further, with a decreasing height Δt of the swelled portion, the slip-through of the toner does not readily generate. That is, in this graph, when the data is in a position closer to the bottom right of the graph, it is possible to compatibly realize the prevention of the everting of the cleaning blade and the prevention of the slip-through of the toner. When the solid line of Embodiment 1 and the broken line of Comparison Examples 1 and 2 are compared, the solid line of Embodiment 1 is in the position close to the bottom right of the graph, and therefore it was confirmed that the everting prevention of the cleaning blade 12 and the slip-through prevention of the toner were compatibly achieved at a higher degree in Embodiment 1 compared with Comparison Examples 1 and 2.

Embodiment 2

As in Second Embodiment, the hardened portion 116 was formed on the cleaning blade 112 in which the edge layer 114 and the base layer 115 were partly superposed (FIG. 4). The hardening was made by impregnating the cleaning blade 112 with the isocyanate compound from a side surface including the edge portion 114*a* in a proper amount. The processing time was 40 minutes in which the isocyanate compound was contacted to the cleaning blade 112 and was left standing, and the height Δt of the swelled portion 116*a* was 15 μm. The length h1 of the hardened portion 116 with respect to the extension direction h was 2.5 mm, and the length h2 of the edge layer 114 with respect to the extension direction h was 3 mm, so that h1<h2 was satisfied and thus the base layer 115 was not subjected to the hardening. Also in Embodiment 2, the length t1 of the hardened portion 116 with respect to the thickness direction t was made shorter than the length t2 of the edge layer 114 with respect to the thickness direction t. A result of evaluation of this cleaning blade 112 is shown in Table 3 and (b) of FIG. 7. As shown in Table 3, there was no everting of the cleaning blade 112, and also the cleaning property was good.

TABLE 3

| | EMB. 2 | COMP. EX. 3 |
|---|---|---|
| h2 (mm) | 3 | 3 |
| h1 (mm) | 2.5 | 4 |
| h1:h2 | h1 < h2 | h1 > h2 |
| AD*1 | SIDE | END |
| PT*2 | 40 min | 40 min |
| BE*3 | ○ | ○ |
| TST*4 | ○ | 18000 NG |

*1"AD" is the application direction. "SIDE" means from the side surface. "END" means from the end (edge) surface.
*2"PT" is the processing time (minutes).
*3"BE" is the blade everting. "○" means that no everting was observed.
*4"TST" is the toner slip-through. "○" means that no slip-through of the toner was observed. "18000 NG" means that the slip-through of the toner was observed at the time of the printing of 18000 sheets.

Comparison Example 3

As in Second Embodiment, the hardened portion was formed on the cleaning blade in which the edge layer and the base layer were partly superposed (FIG. 4). The hardening was made by impregnating the cleaning blade with the isocyanate compound from a side surface including the edge portion in a proper amount. The processing time was 40 minutes in which the isocyanate compound was contacted to the cleaning blade and was left standing, and the height Δt of the swelled portion was 25 μm. The length h1 of the hardened portion with respect to the extension direction h was 4 mm, and the length h2 of the edge layer with respect to the extension direction h was 3 mm, so that h1>h2 was satisfied and thus the hardened portion was formed on both of the edge layer and the base layer. A result of evaluation of this cleaning blade is shown in Table 3 and (b) of FIG. 7. As shown in Table 3, with respect to the cleaning property, after 18000 sheets, an image defect due to the slip-through of the toner generated.

As shown in (b) of FIG. 7, a characteristic of the cleaning blade 112 which is derived from Second Embodiment and other embodiments (unshown) and on which the hardened portion 116 in Embodiment 2 is formed is shown by a solid line. A characteristic of the cleaning blade which is derived from Comparison Example 3 and other comparison examples (unshown) and on which another hardened portion is formed is shown by a broken line. Similarly as in (a) of FIG. 7, in this graph, when the data is in a position closer to the bottom right of the graph, it is possible to compatibly realize the prevention of the everting of the cleaning blade and the prevention of the slip-through of the toner. When the solid line of Embodiment 2 and the broken line of Comparison Example 3 are compared, the solid line of Embodiment 2 is in the position close to the bottom right of the graph, and therefore it was confirmed that the everting prevention of the cleaning blade and the slip-through prevention of the toner were compatibly achieved at a higher degree in Embodiment 2 compared with Comparison Example 3.

According to the present invention, the portion which is the part of the edge layer including the edge portion and which does not reach the base layer from the surface of the edge layer is subjected to the hardening, and therefore only the edge layer can be subjected to the hardening. For this reason, the generation of the stepped portion between the portion which is subjected to the hardening and the portion which is not subjected to the hardening can be suppressed.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-106045 filed on May 22, 2014, which is hereby incorporated by reference herein in its entirety.

What is claimed is:

1. An image forming apparatus comprising:

a rotatable image bearing member;

an image forming portion for forming a toner image on the image bearing member; and a cleaning blade for removing a toner on the image bearing member in contact with the image bearing member, wherein the cleaning blade has an edge layer which includes an edge portion contacting the image bearing member and which is formed of a first resin material, and has a base layer which is provided superposedly on the edge layer so as to support the edge layer with respect to a thickness direction of the cleaning blade and which is formed of a second resin material different from the first resin material, wherein the cleaning blade includes a hardened portion, at a part of the edge layer including the edge portion, subjected to hardening so as to be harder than another portion of the edge layer, and wherein the hardened portion has a length shorter than a length of the edge layer with respect to the thickness direction.

2. The image forming apparatus according to claim 1, wherein with respect to an extension direction of the cleaning blade toward the image bearing member, a length of the hardened portion is shorter than a length of the edge layer.

3. The image forming apparatus according to claim 1, wherein the base layer includes an exposed portion exposed at a surface thereof in a side where the edge layer is provided, and wherein the edge layer is disposed adjacently to the exposed portion with respect to an extension direction of the cleaning blade toward the image bearing member.

4. The image forming apparatus according to claim 1, wherein the hardening is made at end portions of the edge layer with respect to a widthwise direction parallel to a rotational axis direction of the image bearing member.

5. The image forming apparatus according to claim 1, wherein the another portion of the edge layer has an impact resilience lower than an impact resilience of the base layer.

6. The image forming apparatus according to claim 1, wherein the edge layer is formed of a polyurethane resin material.

7. The image forming apparatus according to claim 6, wherein the hardening is made by impregnating the polyurethane resin material with an isocyanate compound.

8. A cleaning blade comprising:

an edge layer which includes an edge portion and which is formed of a first resin material;

a base layer which is provided superposedly on the edge layer so as to support the edge layer with respect to a thickness direction of the cleaning blade and which is formed of a second resin material different from the first resin material; and a hardened portion, provided at a part of the edge layer including the edge portion, subjected to hardening so as to be harder than another portion of the edge layer, wherein the hardened portion has a length shorter than a length of the edge layer with respect to the thickness direction.

9. An image forming apparatus comprising:

a rotatable image bearing member; and a cleaning blade for removing a toner on the image bearing member in contact with the image bearing member, wherein the cleaning blade has an edge layer which includes an edge portion contacting the image bearing member and which is formed of a first resin material, and has a base layer which supports the edge layer and which is formed of a second resin material different from the first resin material, wherein the cleaning blade includes a hardened portion, at a part of the edge layer including the edge portion, subjected to hardening so as to be harder than another portion of the edge layer, and wherein in the edge layer including the edge portion, between the hardened portion and a region other than the hardened portion, a difference in thickness of the cleaning blade is 25 μm or less and a difference in dynamic hardness is 0.07 mN/(μm×μm) to 0.27 mN (μm×μm).

10. A cleaning blade comprising:

an edge layer which includes an edge portion and which is formed of a first resin material;

a base layer which supports the edge layer and which is formed of a second resin material different from the first resin material; and a hardened portion, provided at a part of the edge layer including the edge portion, subjected to hardening so as to be harder than another portion of the edge layer, wherein in the edge layer including the edge portion, between the hardened portion and a region other than the hardened portion, a difference in thickness of the cleaning blade is 25 μm or less and a difference in dynamic hardness is 0.07 mN/(μm×μm) to 0.27 mN (μm×μm).

11. An image forming apparatus comprising:

a rotatable image bearing member; and a cleaning blade for removing a toner in contact with the image bearing member, wherein the cleaning blade has an edge layer which includes an edge portion contacting the image bearing member and which is formed of a first resin material, and has a base layer which supports the edge layer and which is formed of a second resin material different from the first resin material, wherein a portion which is a part of the edge layer including the edge portion and which extends from a surface of the edge layer and does not reach the base layer is subjected to hardening so as to be harder than another portion of the edge layer.

12. A cleaning blade comprising:

an edge layer which includes an edge portion and which is formed of a first resin material; and a base layer which supports the edge layer and which is formed of a second resin material different from the first resin material, wherein a portion which is a part of the edge layer including the edge portion and which extends from a surface of the edge layer and does not reach the base layer is subjected to hardening so as to be harder than another portion of the edge layer.

13. An image forming apparatus comprising:

a rotatable image bearing member;

an image forming portion for forming a toner image on the image bearing member;

a cleaning blade for removing a toner on the image bearing member in contact with the image bearing member, wherein the cleaning blade has an edge layer which is an elastic member and includes an edge portion contacting the image bearing member, and has a base layer which is an elastic member having an impact resilience larger than an impact resilience of the edge layer and is provided superposedly on the edge layer so as to support the edge layer with respect to a thickness direction of the cleaning blade, and a hardened portion, provided at an end portion of the edge portion with respect to a rotational axis direction of the image bearing member, subjected to hardening so as to be harder than another portion of the edge layer, wherein the hardened portion has a length shorter than a length of the edge layer with respect to the thickness direction.

14. The image forming apparatus according to claim 13, wherein with respect to an extension direction of the cleaning blade toward the image bearing member, a length of the hardened portion is shorter than a length of the edge layer.

15. The image forming apparatus according to claim 13, wherein the base layer includes an exposed portion exposed at a surface thereof in a side where the edge layer is provided, and wherein the edge layer is disposed adjacently to the exposed portion with respect to an extension direction of the cleaning blade toward the image bearing member.

16. The image forming apparatus according to claim 13, wherein the edge layer is formed of a polyurethane resin material.

17. The image forming apparatus according to claim 16, wherein the hardening is made by impregnating the polyurethane resin material with an isocyanate compound.

18. The image forming apparatus according to claim 16, wherein the hardened portion is provided at each of end portions of the edge portion with respect to the rotational axis direction of the image bearing member.

19. The image forming apparatus according to claim 16, further comprising a developing device for forming the toner image on the image bearing member, wherein the hardened portion is provided at a position outside a maximum width in which the toner image is formed by the developing device with respect to the rotational axis direction.

20. A cleaning blade comprising:

an edge layer which includes an edge portion and which is an elastic member;

a base layer which is provided superposedly on the edge layer so as to support the edge layer with respect to a thickness direction of the cleaning blade and which is an elastic member having an impact resilience larger than an impact resilience of the edge layer; and a hardened portion, provided at an end portion of the edge portion with respect to a longitudinal direction of the cleaning blade, subjected to hardening so as to be harder than another portion of the edge layer, wherein the hardened portion has a length shorter than a length of the edge layer with respect to the thickness direction.

21. The cleaning blade according to claim 20, wherein with respect to a direction perpendicular to the longitudinal direction and the thickness direction, a length of the hardened portion is shorter than a length of the edge layer.

22. The cleaning blade according to claim 20, wherein the base layer includes an exposed portion exposed at a surface thereof in a side where the edge layer is provided, and wherein the edge layer is disposed adjacently to the exposed portion with respect to a direction perpendicular to the longitudinal direction and the thickness direction.

23. The cleaning blade according to claim 20, wherein the edge layer is formed of a polyurethane resin material.

24. The cleaning blade according to claim 23, wherein the hardening is made by impregnating the polyurethane resin material with an isocyanate compound.

* * * * *